United States Patent [19]

Büttner

[11] 4,382,405

[45] May 10, 1983

[54] MACHINE FOR BINDING PACKAGES

[76] Inventor: Hans H. Büttner, 4020 Mettmann, Obmettmann 13, Fed. Rep. of Germany

[21] Appl. No.: 208,599

[22] Filed: Nov. 19, 1980

[30] Foreign Application Priority Data

Dec. 8, 1979 [DE] Fed. Rep. of Germany ..... 2949519

[51] Int. Cl.[3] ..... B65B 13/12

[52] U.S. Cl. ..... 100/7; 53/588; 100/3; 100/28; 198/343

[58] Field of Search ..... 100/3, 7, 27, 28, 178, 100/222, 8; 198/343; 53/582, 588; 141/101, 135

[56] References Cited

U.S. PATENT DOCUMENTS 3,099,204 7/1963 Stromberg ..... 100/28
4,201,127 5/1980 Pasic ..... 100/7

FOREIGN PATENT DOCUMENTS 2341614 3/1975 Fed. Rep. of Germany ..... 100/7
8100548 3/1981 Fed. Rep. of Germany ..... 100/8

*Primary Examiner*—Billy J. Wilhite
*Attorney, Agent, or Firm*—Martin A. Farber

[57] ABSTRACT

A machine for tying packages having a guide device for the tying means, the guide device placing the tying means on a prescribed path around the package which is supported below a press on a conveyor belt, the press effecting a pressing operation on the package, the machine also having a fastening device which connects the ends of the tying means. The press is arranged on a carriage which travels along synchronously with the conveyor belt, which conveyor belt is moved even during the pressing process, or the guide device for the tying means and the fastening device are arranged on a carriage which travels along synchronously with the conveyor belt, the latter being moved even during the tying process.

10 Claims, 10 Drawing Figures

MACHINE FOR BINDING PACKAGES

The present invention relates to a machine for tying packages having a guide device for the tying means, the guide device placing the tying means on a prescribed path around the package which is supported below a press on a conveyor belt, the machine also having a fastening device which connects the ends of the tying means.

Such a machine is known, for instance, from West German Pat. No. 2 051 207. The conveyor belt for the package consists of two individual belts located one behind the other, a gap for the tying means being left between them. After the package comes into the correct position for tying, the conveyor belts stop and the press, which is arranged above the package, comes down on the package and holds it firmly even during the tying process. Once this process has been completed, the individual belts are again placed in motion and they transport the package to the delivery point. This system makes it possible to tie about 27 to 28 packages a minute, based on a length of package of 500 mm. The tying of packages becomes problematic with such machines if the packages have only a small resting surface or little stability.

The object of the invention is to provide a machine of this type the construction of which is more advantageous in use and which has a higher tying capacity.

This object is achieved by the fact that the press (39, 40) is arranged on a carriage (5) which travels along synchronously with the conveyor belt (8), which conveyor belt is moved even during the pressing process and that the package table which supports the resting sections of the conveyor belt (8) is formed of overlapping bars (26, 28) which are arranged spaced from each other and extend on the one hand from the carriage (5) and on the other hand from the machine frame (2).

This object is also achieved by the fact that the guide device (33) for the tying means and the fastening device (31) are arranged on a carriage (5) which travels along synchronously with the conveyor belt (8), the latter being moved even during the tying process and that the package table which supports the resting sections of the conveyor belt (8) is formed of overlapping bars (26, 28) which are arranged spaced from each other and extend on the one hand from the carriage (5) and on the other hand from the machine frame (2).

As a result of this development there is provided a machine of the above type which operates with a higher capacity. Now about 40 packages of the above-indicated package length can be tied per minute. Operations are now carried out during the passage of the package through the machine which in the prior art were carried out with the package stationary. In accordance with the first mentioned cooperative features the press enters into action before the package comes into the tying position. Since the press travels with the same speed as the package, there is no sudden deceleration of the package. Accordingly, packages of small resting surface or slight stability can be held fixed without changes in position which would impede the tying process. Only after this is the conveying motion stopped and the tying effected. Once this has been done, the carriage bearing the press moves back into the starting position and is ready to receive the next package. In the case of packages of large resting surface and large stability the development in accordance with the second mentioned cooperate features is suitable. The transport movement of the conveyor belt then need not be stopped. When the package has reached the proper position for tying, the carriage bearing the guide device for the tying means and the fastening device travels along with the package and the tying is then effected. It is optimum, however, if the press and the guide device for the tying means as well as the fastening device carry out their operations during the passage of the package.

After the termination of the tying process, the carriage then moves backward at high speed. In order to keep losses of time as small as possible, the carriage moves into the starting position immediately upon the completion of the tying process. In this case one can get along with a single conveyor belt, due to the suitable arrangement on the carriage of the guide rollers which leave the tying slot between them. The conveyor belt tension is retained without costly belt tensioning devices regardless of the direction in which the carriage travels. Furthermore, despite this arrangement it is not necessary to dispense with a supporting of the conveyor belt. The bars of the carriage and of the machine frame provide a reliable support surface for the package. If, for instance, one resting section of the conveyor belt becomes smaller, the bars associated with it move together a greater amount while the bars of the other resting surface move apart. If the carriage bars are seated on swingable brackets of the carriage this results in advantages in construction and installation. The pivot pin of the bracket is then at the same time a point of deflection for the loop of the conveyor belt.

One illustrative embodiment of the invention will be explained below with reference to FIGS. 1 to 10, in which.

Figure 1:
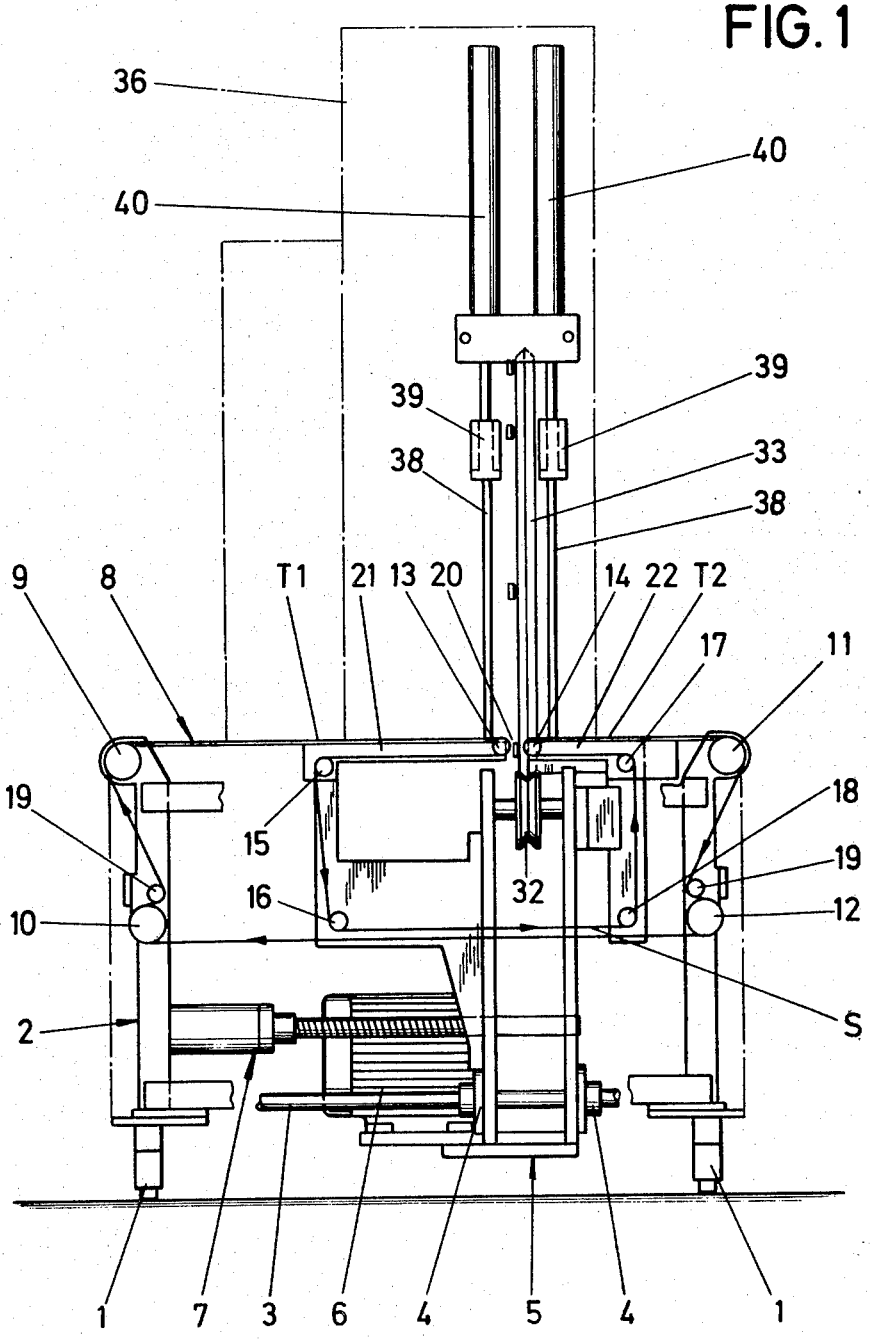
FIG. 1 shows diagrammatically a longitudinal section through the machine.

The machine comprises a machine frame 2 which rests on supporting feet 1. The machine frame carries in its lower region two guide bars 3 of circular cross section located at the same height and parallel to each other. The bars extend in the direction of conveyance of the package P and pass through bearing bushings 4 of a carriage 5. On the carriage 5 there is a drive motor 6 which, via drive parts on the carriage, not shown, is coupled to a worm drive 7 of the machine frame 2. In this way it is possible for the carriage to travel both in one direction and the other.

A conveyor belt 8 is associated with the machine. This belt is placed both over guide rollers 9, 10, 11, 12 mounted on the machine frame 2 and around guide rollers 13, 14 mounted on the carriage 5. The guide rollers 13, 14 leave the tying gap or slot 20 free between each other. These guide rollers 13, 14 guide the on-coming and departing courses T1 and T2 of the conveyor belt 8 which are connected with each other by a loop S which lies within the carriage 5. The guide rollers for the loop S are formed by rollers 15, 16, 17 and 18 which are mounted on the carriage.

In addition there are also two tensioning rollers 19 which extend between the guide rollers 9, 10 and 11, 12 of the machine frame, which guide rollers are located one above the other.

In movement the conveyor belt 8 is moved in the direction indicated by the arrows by the drive motor 6 via drive means, not shown.

Figure 2:
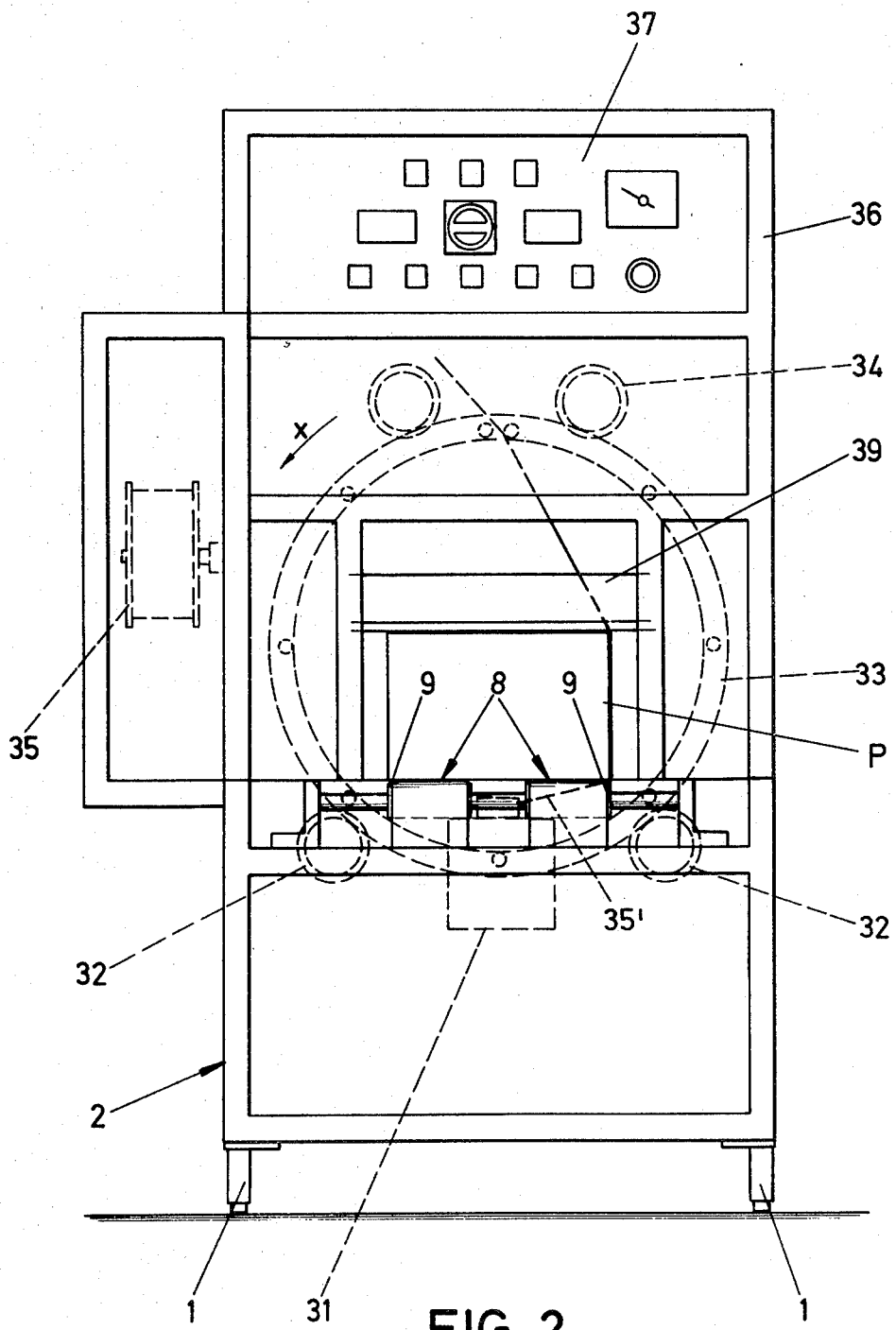
FIG. 2 is a front view of the machine.

In the embodiment shown by way of example, two conveyor belts 8 which are parallel to each other are provided, as can be noted from FIG. 2. The upper region of the conveyor belts 8 here forms the supporting table for the package P.

The guide rollers 13, 14 of the carriage 5 which leave the tying gap 20 between each other are mounted on brackets 21, 22. The latter, in their turn, are swingable about pivot pins 15' and 17' respectively on supports 23, 24 provided on the carriage. The pivot pins 15', 17' by their extension form the deflection points 15 and 17 respectively of the conveyor belt loop S.

Near the guide rollers 13 and 14 the brackets 21, 22 are connected by cross members 25 respectively. From them there extend bars 26 arranged spaced from each other. The free end of the latter is supported by cross members 27 of the brackets 21, 22. On these cross members 27 there also rest the free ends of machine bars 28 which overlap the free ends of the other bars 26 and enter into the spaces between them. The bars 28 are supported on cross members 29 on the machine frame 2. The bars 26, 28 represent the package table, which supports the resting sections of the conveyor belt 8.

Within the conveyor-belt loop S the fastening unit 31 is arranged on the carriage 5.

The carriage 5 furthermore carries two drive pulleys 32 for the tying ring 33, which forms the guide device for the tying means. With this ring there are associated other guide pulleys 34 arranged on the carriage. The tying ring 33 may be turned both in the direction of the arrow x and opposite thereto. In this way, the tying means which is withdrawn from a tying means storage roll 35 is placed around the package P. The storage roll 35 can also be supported on the carriage and participate in the movement of the latter.

The tieing ring 33 is covered by a tunnel-shaped structure 36 of the machine frame 2. In its upper region this upper structure 36 carries a switchboard 37 containing the corresponding switch and control instruments.

Furthermore the carriage 5 has vertical guide rods 38 for the press beams 39. On both sides of the tieing plane there extends a press beam 39, arranged parallel thereto. Lift cylinders 40 bring the press beams 39 into the corresponding position.

Figure 3:
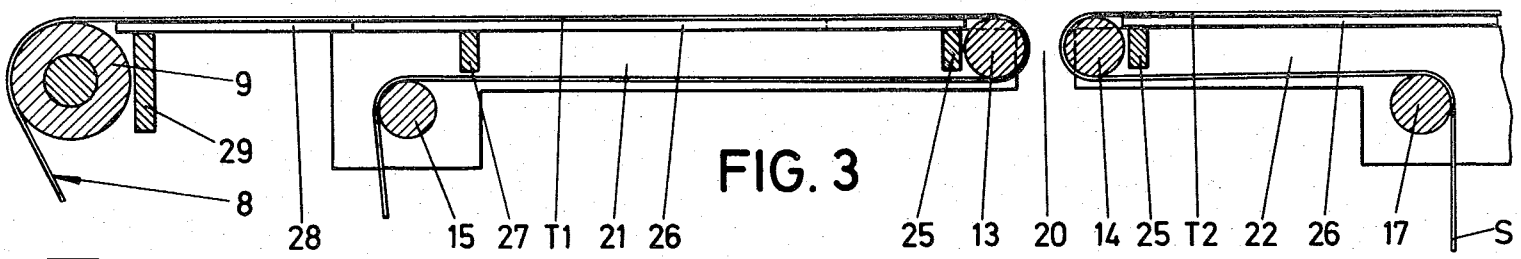
FIG. 3 is a longitudinal section through the upper entrance-side region of the conveyor belt, with the carriage being in its starting position.
Figure 4:
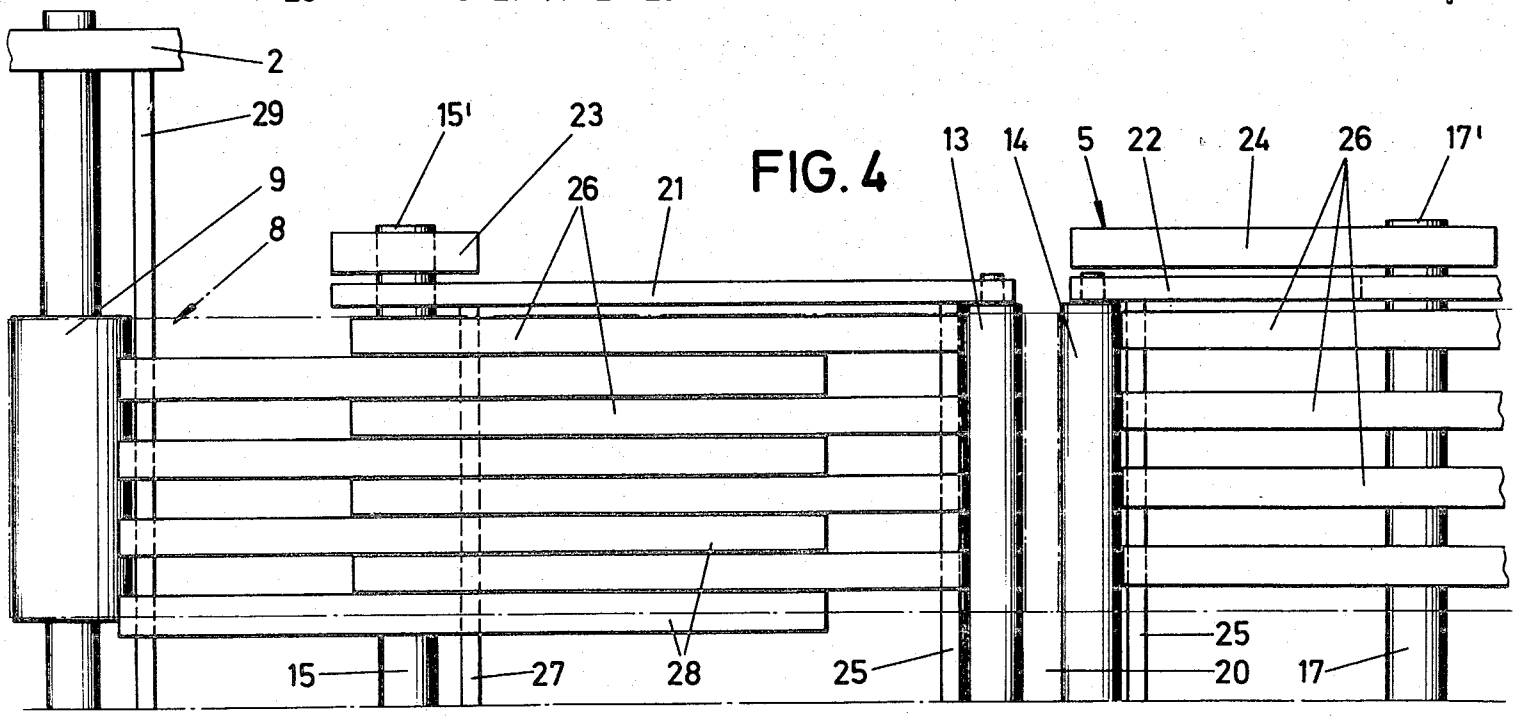
FIG. 4 is a top view of FIG. 3.
Figure 5:
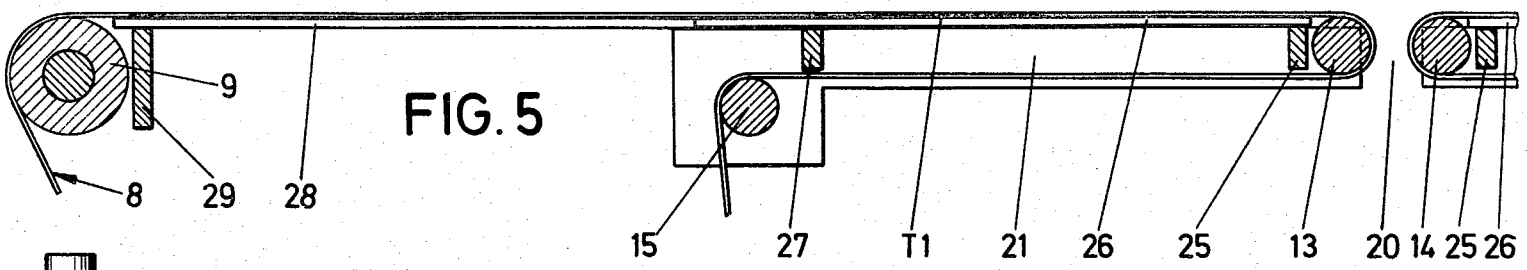
FIG. 5 is a view corresponding to FIG. 3 in which the carriage is in its position after the completion of the tying process.
Figure 6:
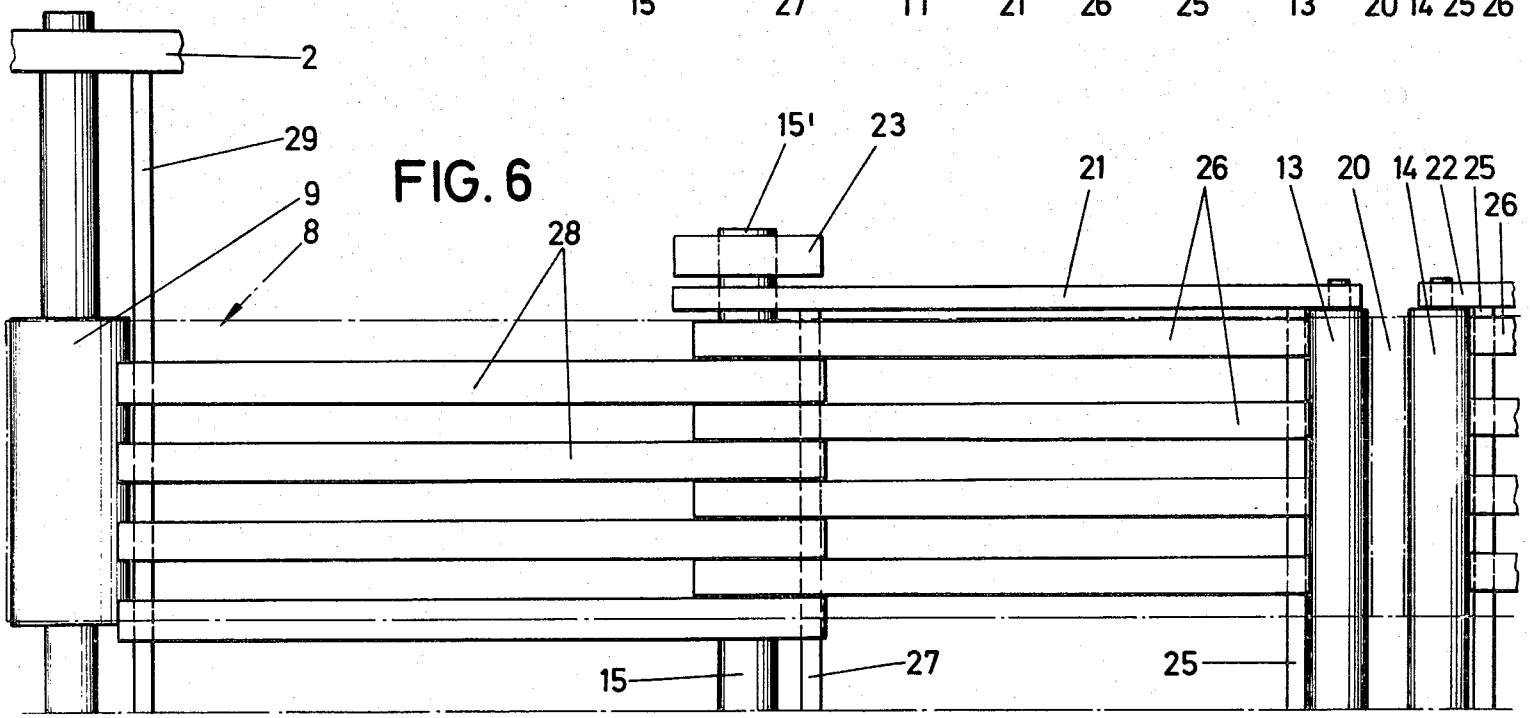
FIG. 6 is a top view of FIG. 5.
Figure 8:
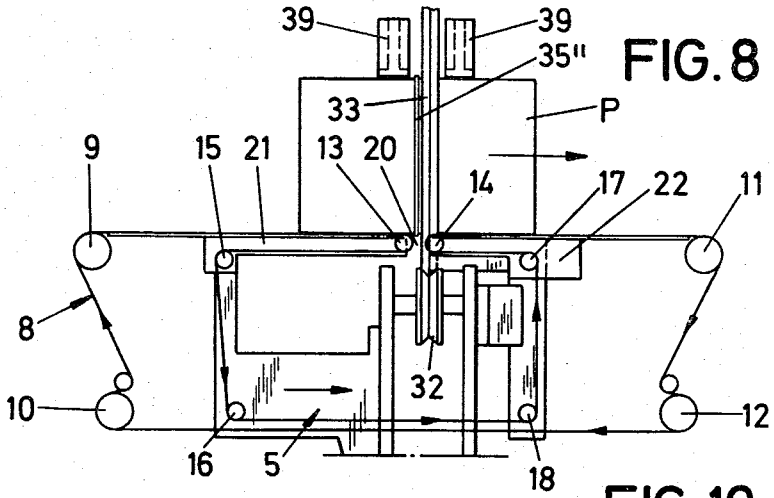
FIGS. 7 to 10 show diagrammatically respective positions during the tying of a package.
Figure 7:
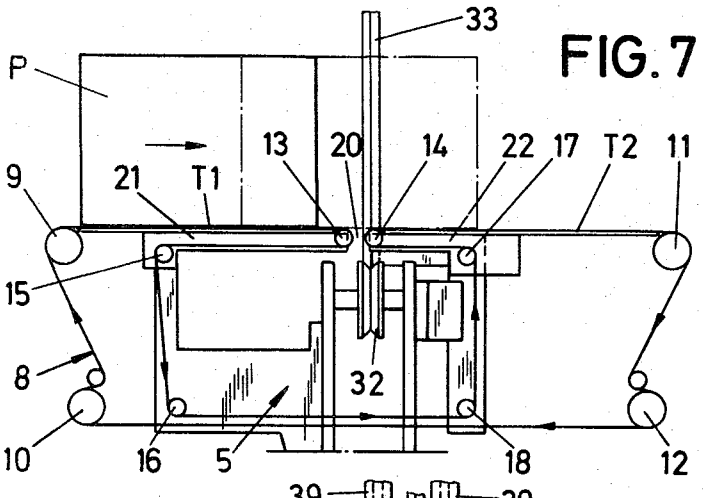
Figure 10:
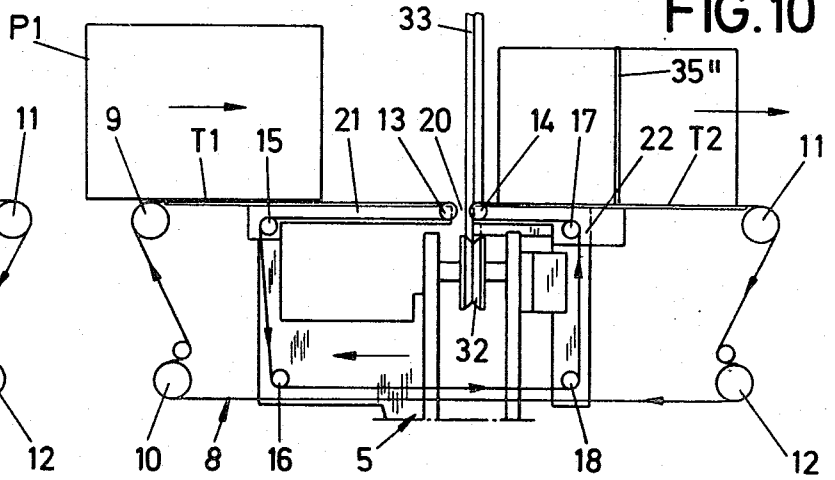
Figure 9:
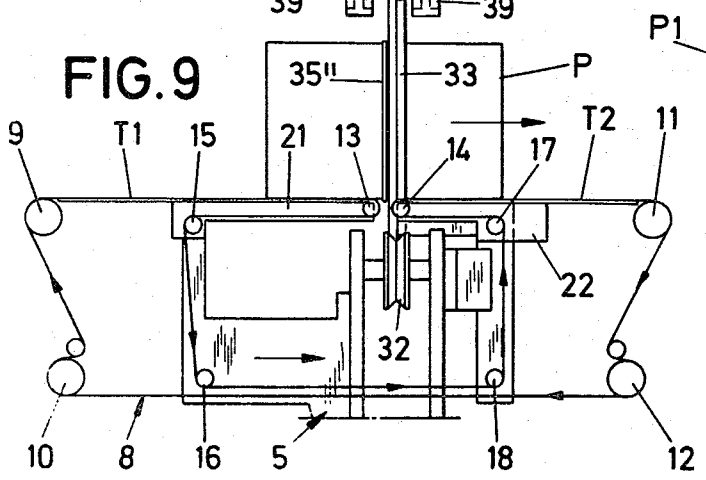

In the starting position of the machine the end 35' of the tieing means is held by the fastening device 31 (FIG. 2). The carriage 5 is in the position shown in FIGS. 3, 4 and 7. The conveyor belt 8 moves continuously in the direction indicated by the arrows drawn on the belt. If the package P is now placed on, the package travels into the position for tieing which is shown in dot-dashed line in FIG. 7. After reaching this position the carriage moves (as indicated by the horizontal carriage movement arrow) with the same speed as the conveyor belt 8. During this movement the press beams 39 move downwardly and thereupon the tieing process begins with the production of the tieing 35'', see FIG. 8. Thereupon the press beams 39 release the package; see FIG. 9. The package P travels further to the point of removal and the carriage 5 travels to its reversal point shown in FIG. 1. Thereupon the carriage 5 moves backward at high speed, and the next package P1 can already be placed thereon. The completely tied package can be removed and the package P1 now passes through the machine.

The shortest tying times are obtained if the return movement of the carriage 5 commences immediately after completion of the tying process and release of the package by the press.

The machine can also be controlled in such a manner that after the press beams 39 move down the movement of the conveyor belt and of the carriage is stopped. The tying process then takes place. Thereupon the package travels to the place of removal while the carriage returns again to its starting position. However, in all cases the advantage is obtained that while the package passes through the machine operations are carried out, which increase the economy of the machine.

I claim:

1. In a machine for tying packages having a conveyor belt, tying means, a guide device for the tying means, and a press, the guide device placing the tying means on a prescribed path around the package which is supported below the press on the conveyor belt, the press effecting a pressing operation on the package, the machine also having a fastening device which connects the ends of the tying means, the improvement comprising a carriage, said press being mounted on said carriage, means for synchronously moving said carriage along with said conveyor belt, the latter being moved even during the pressing operation, said carriage has guide rollers constituting means for forming courses of the conveyor belt, such that said courses leave a tying slot free between each other and are connected with each other by a loop of the conveyor belt which lies witin said carriage, a machine frame, said carriage is moveable relative to said machine frame, means comprising a package table for supporting package support sections of the courses of said conveyor belt, said package table comprises two sets of overlapping bars, said bars of each of said sets are arranged spaced from each other, one of said sets of bars extends from said carriage, and said other set of bars extends from said machine frame.

2. In a machine for tying packages having a conveyor belt, tying means, a guide device for the tying means, and a press, the guide device placing the tying means on a prescribed path around the package which is supported below the press on the conveyor belt, the press effecting a pressing operation on the package, the machine also having a fastening device which connects the ends of the tying means, the improvement comprising a carriage, said guide device and said fastening device are arranged on said carriage, means for synchronously moving said carriage along with said conveyor belt, the latter being moved even during a tying process, said carriage has guide rollers constituting means for forming courses of the conveyor belt, such that said courses leave a tying slot free between each other and are connected with each other by a loop of the conveyor belt which lies within said carriage, a machine frame, said carriage is moveable relative to said machine frame, means comprising a package table for supporting package support sections of the courses of said conveyor belt, said package table comprises two sets of overlapping bars, said bars of each of said sets are arranged spaced from each other, one of said sets of bars extends from said carriage, and said other set of bars extends from said machine frame.

3. The machine according to claims 1 or 2, wherein said press, said guide device and said fastening device are seated on one and the same said carriage.

4. The machine according to claim 1 or 2 further comprising brackets, said bars of said one set on said carriage are seated on said brackets, said brackets each have a free end, said brackets in a region of said free ends carry said guide rollers, respectively, pivot pins on said carriage form a point of deflection of said loop of said conveyor, respectively, said brackets are mounted pivotally upwardly swingable on said pivot pins, respectively.

5. In a machine for tying packages having a machine frame, a conveyor belt, tying means and a guide device for the tying means, a press, the guide device placing the tying means on a prescribed path around the package, the package being supported below the press on the conveyor belt, the press being provided over the conveyor belt, the press effecting a pressing operation on the package, the machine also having a fastening device which connects the ends of the tying means, the improvement comprising a carriage, said guide device, said tying means, said fastening device and said press being mounted on said carriage, said carriage having guide rollers constituting means for forming courses of the conveyor belt, such that said courses define a tying slot where said courses are free of each other, said courses being connected with each other by a loop of the conveyor belt which lies within said carriage, and wherein said conveyor belt courses include package support sections, said guide rollers comprise two rollers mounted on said carriage spaced apart, defining said slot therebetween, and means comprising a package table for supporting the package support sections of the courses of said conveyor belt, said package table comprising two sets of overlapping bars, said bars of each of said sets being arranged spaced from each other, one of said sets of bars extending from said carriage, and said other set of bars extending from said machine frame, and, means for synchronously moving said carriage along with said conveyor belt relative to said frame, the conveyor belt being movable during the pressing operation.

6. The machine according to claim 5, further comprising pivot pins on said carriage form a point of deflection of said loop of said conveyor, respectively, brackets are mounted pivotally upwardly swingable on said pivot pins, respectively, said one set of bars being seated on said brackets, said brackets each having a free end, said brackets in a region of said free ends carrying said guide rollers, respectively.

7. The machine according to claim 5, wherein the respective bars of said one set alternate with the respective bars of said other set.

8. The machine according to claim 5, wherein the respective bars of said one set are of a first predetermined length and the respective bars of said other set are of a second predetermined length, such that said conveyor belt is supported by said first and second sets of bars during movement of said carriage with respect to said frame from a first predetermined position to a second predetermined position.

9. The machine according to claim 5, wherein said carriage includes a transverse cross member having opposite ends joined to said brackets for supporting said first and second sets of bars during movement of said carriage from said first predetermined position to said second predetermined position.

10. The machine according to claim 5, wherein two of said conveyor belts are spaced and parallel to each other and for cooperatively supporting the package being tied.

* * * * *